US008366497B2

(12) United States Patent
Glick et al.

(10) Patent No.: US 8,366,497 B2
(45) Date of Patent: Feb. 5, 2013

(54) POWER TERMINAL

(75) Inventors: Michael Glick, Farmington Hills, MI (US); Slobodan Pavlovic, Canton, MI (US); Brantley Natter, Brighton, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 111 days.

(21) Appl. No.: 12/963,968

(22) Filed: Dec. 9, 2010

(65) Prior Publication Data

US 2011/0076901 A1 Mar. 31, 2011

Related U.S. Application Data

(63) Continuation-in-part of application No. 12/797,735, filed on Jun. 10, 2010, now Pat. No. 7,892,050.

(60) Provisional application No. 61/187,887, filed on Jun. 17, 2009, provisional application No. 61/416,893, filed on Nov. 24, 2010.

(51) Int. Cl.
*H01R 13/13* (2006.01)

(52) U.S. Cl. ..... 439/839

(58) Field of Classification Search ..... 439/839, 439/884, 857, 825; 29/874
See application file for complete search history.

(56) References Cited

U.S. PATENT DOCUMENTS

| | | | | |
|---|---|---|---|---|
| 2,774,951 | A | 12/1956 | Kinkaid et al. | |
| 2,921,287 | A | 1/1960 | Matthysse et al. | |
| 3,550,069 | A | 12/1970 | Teagno | |
| 3,792,420 | A * | 2/1974 | Konnemann et al. | 439/857 |
| 4,040,713 | A * | 8/1977 | Konnemann | 439/839 |
| 4,385,794 | A | 5/1983 | Lucius | |
| 4,540,235 | A * | 9/1985 | Lolic | 439/839 |
| 4,553,808 | A | 11/1985 | Weidler et al. | |
| 4,570,147 | A | 2/1986 | Ebi | |
| 4,583,812 | A * | 4/1986 | Gross et al. | 439/839 |
| 4,646,052 | A | 2/1987 | Matsunaga et al. | |
| 4,672,352 | A | 6/1987 | Takano | |
| 4,751,490 | A | 6/1988 | Hatagishi | |
| 4,842,534 | A | 6/1989 | Mobley et al. | |
| 4,869,972 | A | 9/1989 | Hatagishi | |
| 4,871,990 | A | 10/1989 | Ikeda et al. | |
| 4,941,851 | A | 7/1990 | Hsueh | |
| 4,958,426 | A | 9/1990 | Endo et al. | |
| 5,007,865 | A | 4/1991 | Jakobeit | |
| 5,022,868 | A | 6/1991 | Legrady | |
| 5,035,661 | A * | 7/1991 | Steinhardt et al. | 439/839 |
| 5,064,379 | A * | 11/1991 | Ryll et al. | 439/81 |
| 5,088,940 | A | 2/1992 | Saito | |
| 5,147,230 | A | 9/1992 | Plyler et al. | |
| 5,226,842 | A | 7/1993 | Endo et al. | |
| 5,295,873 | A * | 3/1994 | Walbrecht | 439/839 |
| 5,334,058 | A * | 8/1994 | Hotea | 439/839 |
| 5,338,229 | A * | 8/1994 | Egenolf | 439/839 |
| 5,350,321 | A | 9/1994 | Takenouchi | |
| 5,362,262 | A * | 11/1994 | Hotea | 439/839 |
| 5,416,461 | A | 5/1995 | Totsuka et al. | |
| 5,427,552 | A | 6/1995 | Zielinski et al. | |
| 5,474,475 | A | 12/1995 | Yamaguchi | |
| 5,488,346 | A | 1/1996 | Kondo et al. | |

(Continued)

FOREIGN PATENT DOCUMENTS

| | | | |
|---|---|---|---|
| JP | 09147731 | A | 6/1997 |
| JP | 2000133114 | A | 5/2000 |

*Primary Examiner* — Alexander Gilman
(74) *Attorney, Agent, or Firm* — Brooks Kushman P.C.

(57) ABSTRACT

An electrical connector formed to have at least one or more pairs of opposing legs extending from a body portion where each leg extends to a contact point where an inner surface of each opposing leg contact. A spring clip can be positioned over one or more of the opposing legs to increase a compressive force. The spring clip may include an alignment feature to limit clip rotating and/or pitching.

20 Claims, 11 Drawing Sheets

U.S. PATENT DOCUMENTS 5,573,434 A * 11/1996 Ittah et al. ..... 439/839
5,581,225 A 12/1996 Oh et al.
5,658,174 A 8/1997 Benes et al.
5,662,487 A 9/1997 Okamura et al.
5,679,034 A 10/1997 Hanazaki et al.
5,716,245 A 2/1998 Kameyama et al.
5,739,741 A 4/1998 Hanazaki et al.
5,745,024 A 4/1998 Ohta et al.
5,795,193 A 8/1998 Yang
5,807,133 A 9/1998 Arnett
5,886,611 A 3/1999 Schaller et al.
6,159,036 A 12/2000 Daoud
6,178,106 B1 1/2001 Umemoto et al.
6,315,599 B1 11/2001 Daoud
6,431,880 B1 8/2002 Davis et al.
6,506,060 B2 1/2003 Sumida et al.
6,558,198 B2 5/2003 Kobayashi et al.
6,759,938 B2 7/2004 Matsumura et al.
6,824,430 B2 11/2004 Matsumura et al.
7,071,808 B2 7/2006 Nakamura
7,094,114 B2 * 8/2006 Kurimoto ..... 439/839
7,592,892 B2 9/2009 Ito et al.
7,594,832 B2 * 9/2009 Oka et al. ..... 439/884
7,595,715 B2 * 9/2009 Pavlovic et al. ..... 337/198
7,612,647 B2 11/2009 Onoda et al.
7,780,489 B2 * 8/2010 Stuklek ..... 439/825
7,892,050 B2 * 2/2011 Pavlovic et al. ..... 439/839
2004/0124963 A1 7/2004 Nakamura
2006/0205267 A1 9/2006 Darr et al.
2008/0224814 A1 9/2008 Pavlovic et al.

* cited by examiner

POWER TERMINAL

CROSS-REFERENCE TO RELATED APPLICATIONS

This application is a continuation-in-part of U.S. application Ser. No. 12/797,735 filed Jun. 10, 2010, entitled "High Power Fuse Terminal With Scaleability", now issued U.S. Pat. No. 7,892,050 B2, which, in turn, claims the benefit of U.S. Provisional Application No. 61/187,887 filed Jun. 17, 2009, entitled "High Power Fuse Terminal With Scaleability". This application further claims the benefit of U.S. Provisional Application 61/416,893 filed Nov. 24, 2010, entitled "Power Terminal". The disclosures of which are incorporated in their entirety by reference herein.

BACKGROUND OF THE INVENTION

1. Field of the Invention

The present invention relates to terminals, such as but not limited to power terminals operable within a vehicle to support transport of high power currents.

2. Background Art

Copper has good electrical conductivity properties, and has been a preferred material for the terminals. However, copper is susceptible to relaxation (i.e., loss of spring force) as the temperature increases. Since temperature of the terminals increases as the current drawn in the electrical circuit increases, copper terminals have a reduced ability to maintain strong clamping force onto the male terminal blades. Relaxation of the female terminals decreases the overall contact area with the male blades, resulting in reduced electrical conductivity, increased resistance, and a further increase in temperature. It is desirable to keep the overall size of an electrical distribution box or other connectors as small as possible while still providing the necessary current-carrying capacity. For any particular size of a fuse, the thickness and width of the female terminals is correspondingly limited. Therefore, the spring force cannot be further increased by simply making the terminals thicker or wider. When copper is used, the size limitations may make the desired spring force unattainable. Consequently, copper alloys for which relaxation does not occur until higher temperatures are reached have been used. On the other hand, copper alloys typically have a lower conductivity. For any particular size (i.e., volume) of fuse, the current capacity is thus reduced. In automotive applications, fuses using copper alloys are typically limited to 60 amps or less.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION OF THE PREFERRED EMBODIMENT(S)

Figure 1:
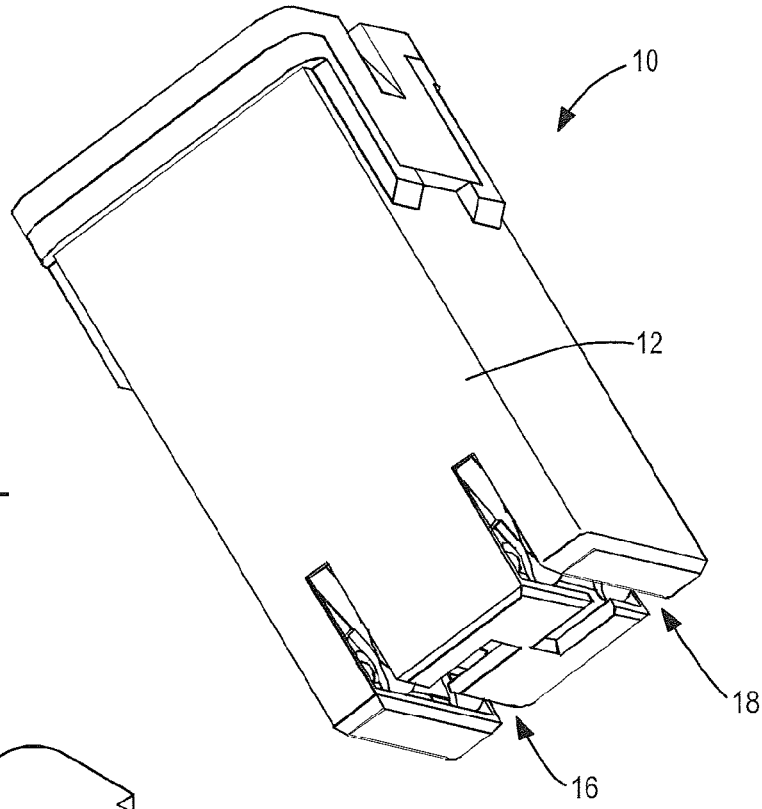
FIG. 1 is a perspective view of a fuse.
Figure 2:
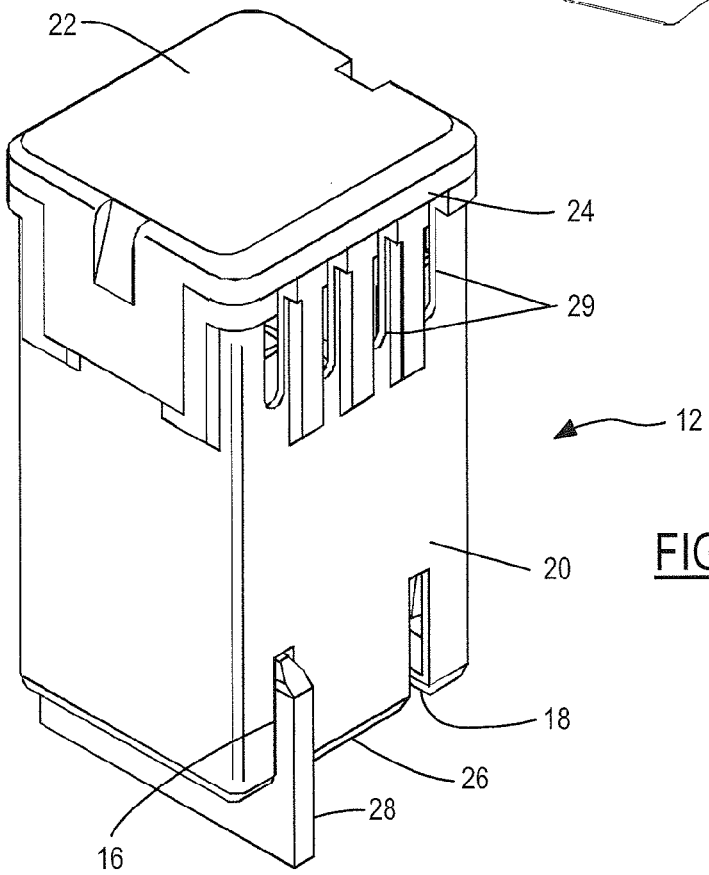
FIG. 2 is a perspective view of a fuse housing.

Referring now to the drawings, there is illustrated in FIG. 1 a high power fuse shown generally at 10. The high power fuse 10 includes a housing 12 and a fuse assembly 14 disposed within the housing 12. The housing 12 includes a first slot 16 for receiving a first terminal blade and a second slot 18 for receiving a second terminal blade. FIG. 2 is a perspective view of the housing 12. The housing 12 is preferably produced from two sections that include a body portion 20 and a lid portion 22. The body portion 20 is an elongated chamber that includes an open end 24 and a closed end 26. The open end 24 is of a sufficient width and length for receiving and housing the fuse assembly 14 (shown in FIG. 3) within the housing 12. The first slot 16 and the second slot 18 are formed in the closed end 26. The slots are aligned with respective receiving members for making an electrical connection with a respective terminal blade (shown generally at 28).

The lid portion 22 attaches to the open end 24 for enclosing the fuse assembly 14 therein. The housing 12 isolates a person or other objects from the fuse assembly 14 within the housing 12 which may otherwise result in an electrical shock to a person contacting the exposed fuse or a short circuit. The body portion 20 includes ventilation slots 29 formed near the closed end 26 of the body portion 20. As heat is generated by the fuse assembly 14 enclosed within the housing 12, the ventilation slots 29 formed near the top of the body portion 20 provide ventilation (e.g., a chimney effect) for dissipating the heat generated by the fuse assembly 14.

Figure 3:
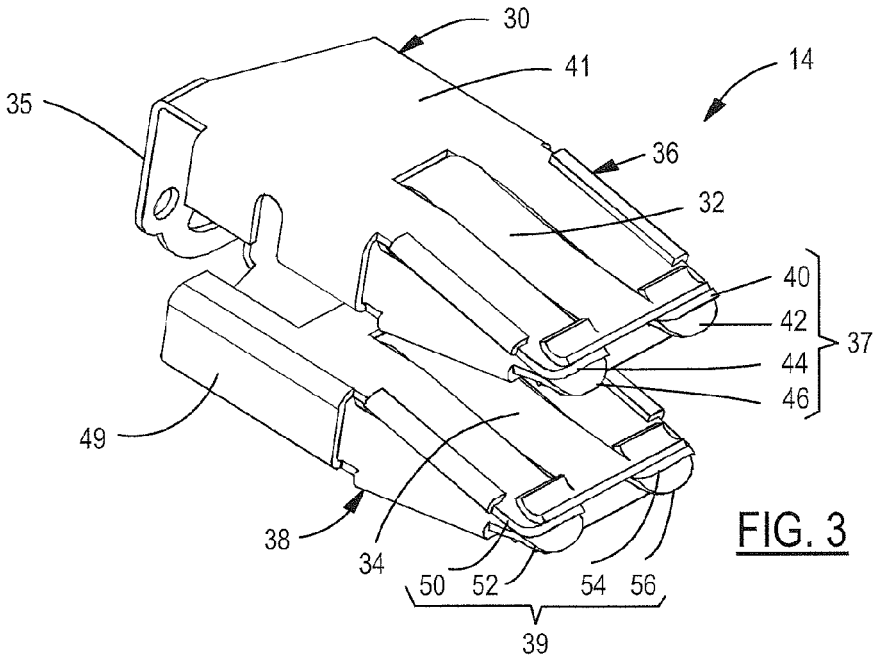
FIG. 3 is a perspective view of a fuse assembly.

FIG. 3 illustrates the fuse assembly 14. The fuse assembly 14 includes a fuse body 30, a first clamp-like member 32, and a second clamp-like member 34. The fuse body 30 is preferably made from a single piece of stamped metal such as copper. The fuse body 30 includes a fuse element 35, a first terminal receptor 36 for receiving a respective male terminal blade (not shown), and a second terminal receptor 38 for receiving respective male terminal blade (not shown). The fuse element 35 is integrally formed between the first terminal receptor 36 and the second terminal receptor 38. The fuse element 35 is produced from the same material as the first terminal receptor 36 and the second terminal receptor 38. In addition, fuse element 35 is plated with a second material, such as tin, that when heated, diffuses into the copper which lowers the melting point of the copper. At a predetermined current draw (corresponding to a predetermined temperature), the tin begins to diffuse into the copper and the diffused portion of the copper begins to melt thereby creating an open circuit within the fuse element 35 for terminating current flow between the first terminal receptor 36 and the second terminal receptor 38.

Figure 4:
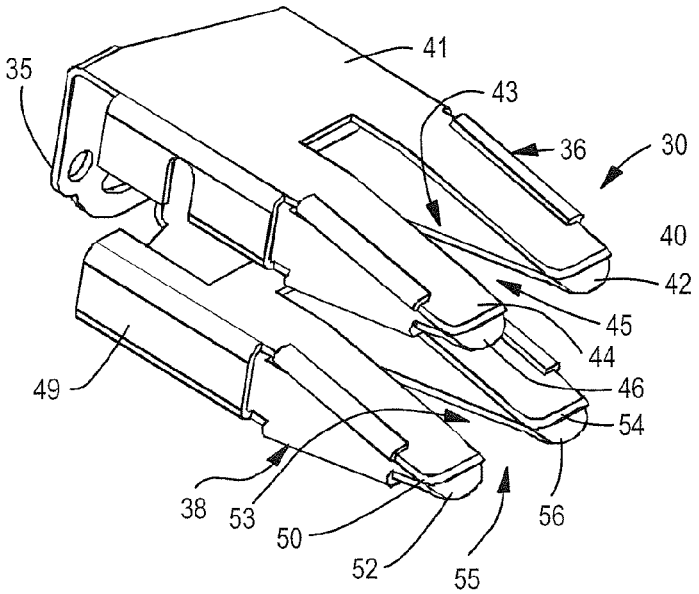
FIG. 4 is a perspective view of a fuse body.

FIG. 4 illustrates a fuse body 30 without the respective clamp-like members. The first terminal receptor 36 includes a body portion 41 having a first set of terminal legs 37 extending from the body portion 41. The body portion 41 is preferably a non-resilient section that conductively couples the fuse element 35 to the first set of terminal legs 37. The first set of terminal legs 37 includes a first leg 40 and a second leg 42 opposing one another. The first set of terminal legs 37 further includes a third leg 44 and a fourth leg 46 opposing one another and positioned adjacent to the first leg 40 and the second leg 42, respectively. The first leg 42 and the third leg 44 are in spaced relation to one another having a respective 5 space 43 therebetween. The second leg 42 and the fourth leg 46 are in spaced relation to one another having a respective space 45 therebetween. Each of the respective legs are resilient for maintaining a compression force on a respective terminal blade received between the first and second legs 40 and 42 and the second and third legs 44 and 46.

The second terminal receptor 38 includes a body portion 49 having a second set of terminals legs 39 extending from the body portion 49. The second set of terminal legs 39 includes a first leg 50 and a second leg 52 opposing one another. The second set of terminal legs 38 further includes a third leg 54 and a fourth leg 56 opposing one another and positioned adjacent to the first leg 50 and the second leg 52. The first leg 50 and the third leg 54 are in spaced relation to one another having a respective space 53 therebetween. The second leg 52 and the fourth leg 56 are in spaced relation to one another having a respective space 55 therebetween. Each of the respective legs are resilient for maintaining a compression force on a respective terminal blade received between the first and second legs 50 and 52 and the second and third legs 54 and 56.

The first clamp-like member 32 is assembled to the fuse body 30 for applying a predetermined compression force against the first set of terminal legs 36. The first clamp-like member 32 is mounted to the first terminal receptor 36 centrally located between the first set of terminal legs 37 within the respective spaces 43 and 45. The first clamp-like member 32 is configured to secure a respective terminal blade between the first set of terminal legs 36 for maintaining a respective contact area during elevated temperatures.

Figure 5:
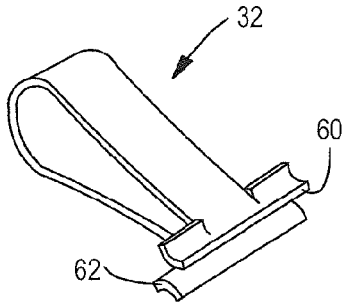
FIG. 5 is a perspective view of a clamp-like member.

FIG. 5 illustrates the clamp-like member 32. The first clamp-like member 32 is a substantially U-shaped body having a first end portion 60 and a second end portion 62. The first end portion 60 and the second end portion 62 can be arc-shaped. The first end portion 60 and the second end portion 62 approach one another as the respective legs of the U-shaped body extend away from the curved base portion of member 32 where the respective legs meet.

Referring again to FIG. 3, when the first clamp like member 32 is mounted to the first set of terminal legs 37, the first end portion 60 contacts an exterior section of the first leg member 40 and third leg member 44. In addition, the second end portion 62 of the first clamp-like member 32 contacts an exterior section of the second leg member 42 and the fourth leg member 46 thereby holding the first and third leg members 40 and 44 in compression with second and fourth leg members 42 and 46, respectively. The first leg member 40 and the third leg member 44 have respective end sections for nesting the first end portion 60 of the first clamp-like member 32 for preventing sliding movement between the first and third leg members 40 and 44 and the first end portion 60. This provides a seating engagement between first and third leg members 40 and 44 and the first end portion 60. Similarly, the second leg member 42 and the fourth leg member 46 have respective end sections for nesting the second end portion 62 of the second clamp-like member 34 for preventing sliding movement between the second and fourth leg members 42 and 46 and the second end portion. This provides a seating engagement between second and fourth leg members 42 and 46 and the second end portion 62.

The first clamp-like member 32 is made of stainless steel which has low relaxation properties at elevated temperatures. As a result, the first clamp-like member 32 prevents the respective terminal legs from relaxing at elevated temperatures which would otherwise reduce the contact area with an associated blade terminal. As a result, the need for utilizing a copper alloy or similar substitute of material with lesser conductive properties is not necessary since relaxation has been minimized. Therefore, a higher conductive material, such as copper (C151), forms the fuse body 30.

Similarly, the second clamp-like member 34 is mounted on the fuse body 30 for applying a predetermined compression force against the second set of terminal legs 38. The second clamp-like member 34 is configured to secure a respective terminal blade between the first set of terminal legs 38 for maintaining a respective contact area during elevated temperature increases. The second clamp-like member 34 is mounted to the second terminal receptor 38 centrally located between the second set of terminal legs 38 within the respective spaces 43 and 45.

A first end portion of the second clamp-like member 34 contacts an exterior portion of the first leg member 50 and third leg member 54. In addition, a second end portion of the second clamp-like member 34 contacts an exterior portion of the second leg member 52 and fourth leg member 56 thereby holding the first and third leg member 50 and 54 in compression with second and fourth leg member 52 and 56, respectively.

The first leg member 50 and the third leg member 54 have respective end sections for nesting the first end portion of the second clamp-like member 34 for preventing sliding movement between the first and third leg members 50 and 54 and the first end portion. This provides a seating engagement between first and third leg members 50 and 54 and the first end portion of the second clamp-like member 34. Similarly, the second leg member 52 and the fourth leg member 56 have respective end sections for nesting the second end portion of the second clamp-like member 34 for preventing sliding movement between the second and fourth leg members 52 and 56 and the second end portion. This provides a seating engagement between second and fourth leg members 52 and 56 and the second end portion of the second clamplike member 34.

The second clamp-like member 34 is made of stainless steel which has low relaxation properties at elevated temperatures. As a result, the second clamp-like member 34 prevents the respective terminal legs from relaxing which could otherwise reduce the contact area with an associated blade terminal. Alternatively, the first and second clamp-like members 32 and 34 may be made of a material other than stainless steel so long as material has less relaxation at elevated temperatures in comparison to the material forming the terminal legs.

The contact area of the electrical coupling of the respective leg members and the respective blade terminals is maintained during elevated temperatures as a result of the normal force applied by the first and second clamp-like member. This results in decreased resistance between the mating terminals which further results in increased conductivity at the respective electrical coupling. As described earlier, high power fuses are typically limited to 60 amps maximum due conductive properties of the copper alloy which is used to prevent relaxation at elevated temperatures. The use of the clamp-like members as described in the present invention allows the fuse body to be made of material with a higher copper content and having higher conductivity than copper alloy, allowing a particular fuse size to obtain an increased current rating at elevated temperatures. For example, a respective fuse body made from substantially 0.4 mm of copper stock for a typical fuse footprint area could handle up to 80 amps. A respective fuse body made from substantially 0.6 mm of copper stock fitting using the same respective footprint could handle up to 100 amps.

Figure 6:
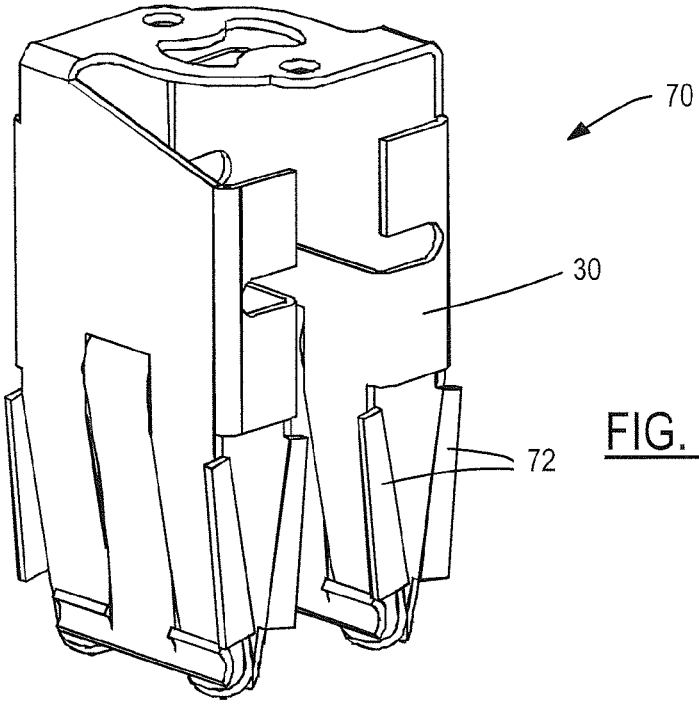
FIG. 6 is a perspective view of another fuse assembly.

FIG. 6 illustrates a high power fuse assembly according to a second preferred embodiment. The fuse assembly 70 includes a plurality of heat sinks 72 for dissipating heat within the fuse body 30. The plurality of heat sinks 72 includes a plurality of fins integrally formed as part of the respective leg members of the fuse body 30. The plurality of fins is positioned so as to allow air to pass over the plurality of fins thereby dissipating heat from the fuse body 30.

Figure 7:
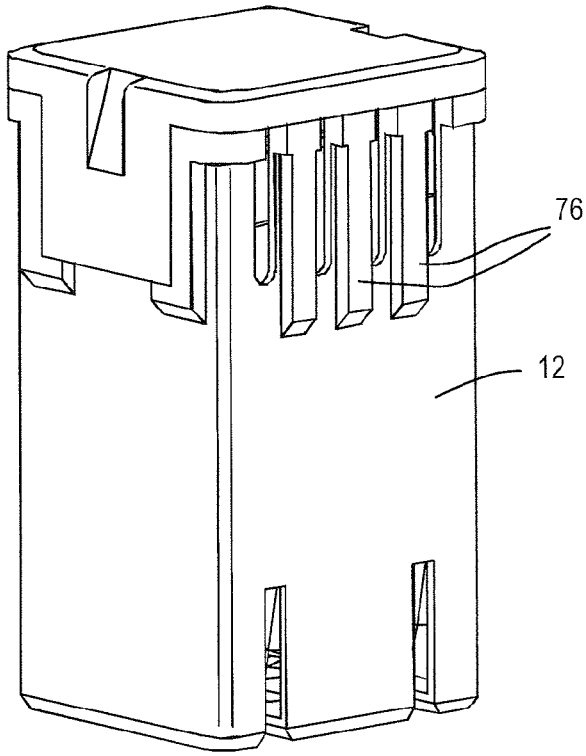
FIG. 7 is a perspective view of another fuse housing.

FIG. 7 illustrates a housing 12 according to a third preferred embodiment. The housing 12 may be made of a plastic polymer that is thermally conductive. A plurality of cooling fins 76 may be formed an the exterior surface of the housing 12 such that heat thermally conducted through the plastic material is dissipated by the air as it flows over the plurality of cooling fins 76.

The present invention facilitates making fuses and connectors with increased current carrying capacity, increased mounting stability, and increased normal forces retaining female terminal receptors on male blade terminals. These improvements are accomplished with a scalable design in which pairs of contact beams are increased above the number shown in the embodiments of FIGS. 1-7. More specifically, each terminal receptor (made of high conductivity material) is provided with three or more pairs of opposing beams. When the overall width of a fuse is increased in order to increase current carrying capacity, rather than just increasing the width of each of the legs in the two pairs of terminal legs as show in FIGS. 1-7, the present invention can in some embodiments use a greater number of beam or leg pairs together with an increase in overall width of the fuse or connector. For example, by modularly expanding from two beam pairs to four beam pairs of the same individual widths, the present invention doubles the maximum current carrying capacity of the fuse/connector while maintaining high normal force on all eight of the individual beams. The present invention also contemplates the use of three or more pairs of opposing beams even when the overall width of the fuse/connector is not increased. In that instance, the additional beam pairs result in greater stability and improved normal forces from the clamping elements. In the most preferred embodiments, the opposing beams all have substantially the same width and are evenly spaced. The present invention further uses a modularly expandable design for the clamping members so that they can be easily integrated onto the terminal receptors.

Figure 8:
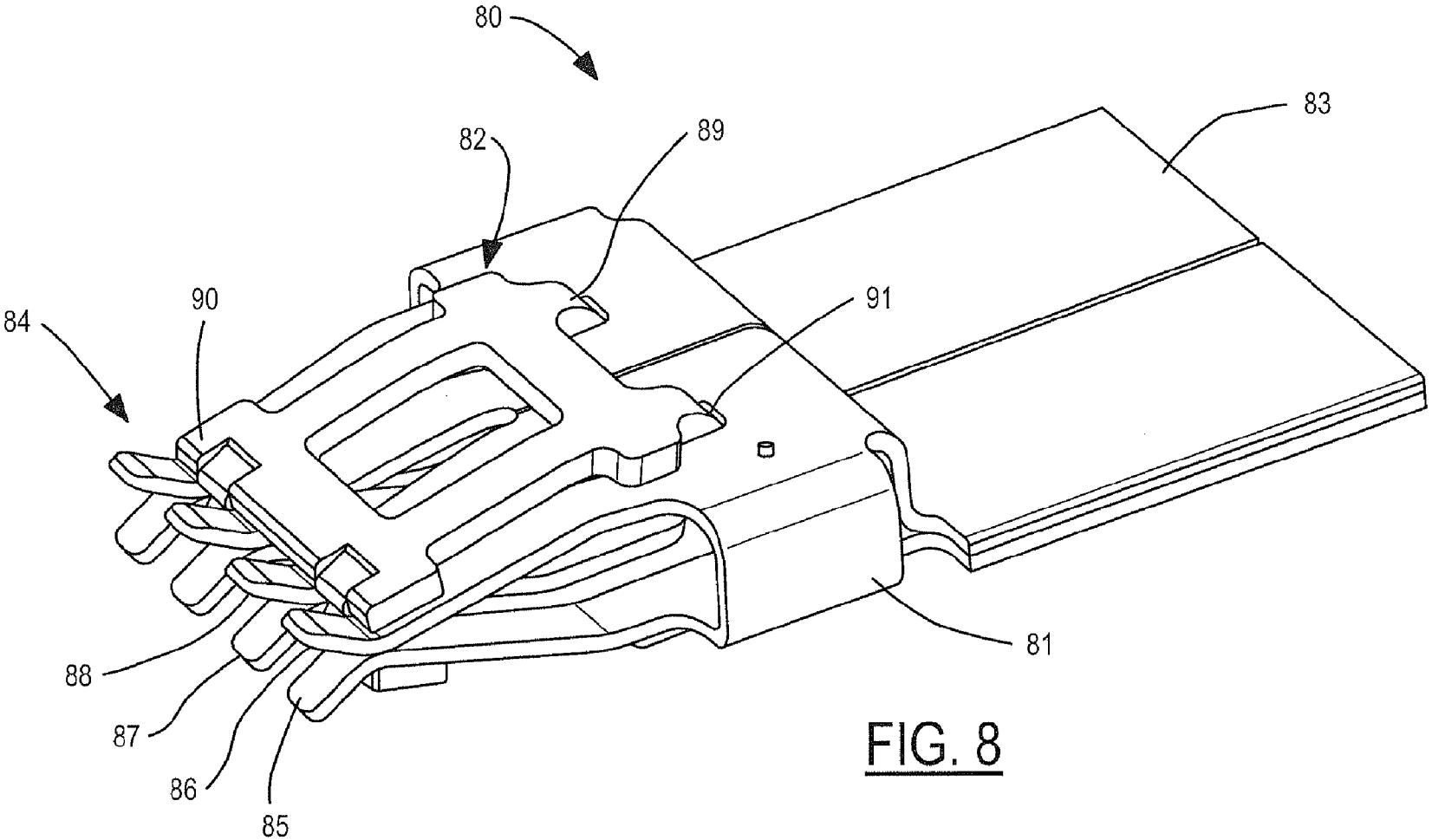
FIG. 8 is a perspective view of a female terminal receptor with an increased number of pairs of opposing beams, according to one embodiment of the invention.
Figure 9:
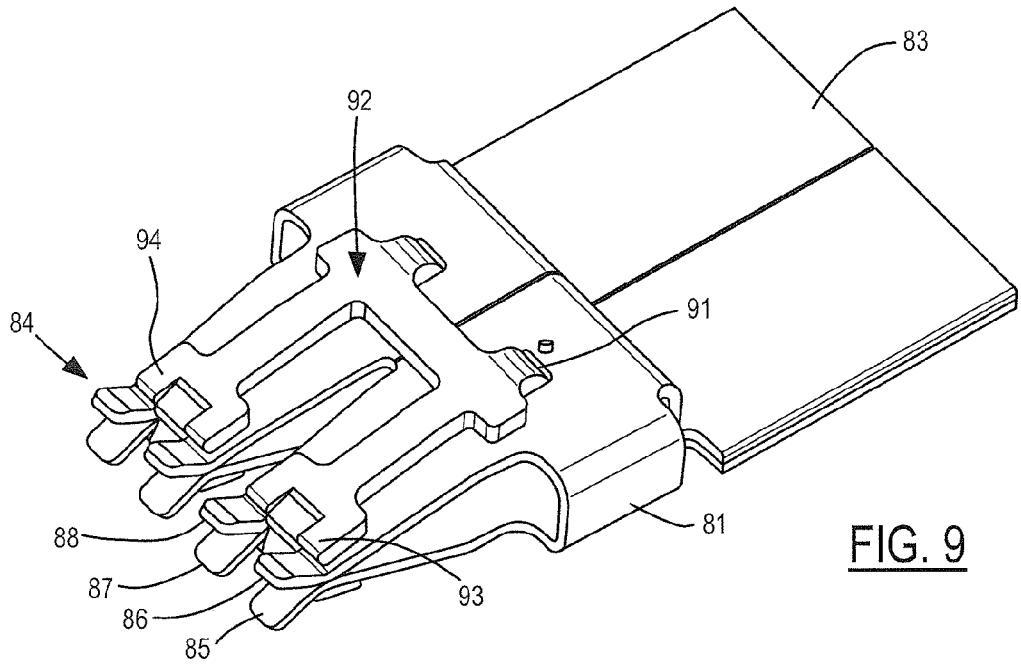
FIG. 9 is a perspective view of a terminal receptor with an alternate clamping member.
Figure 10:
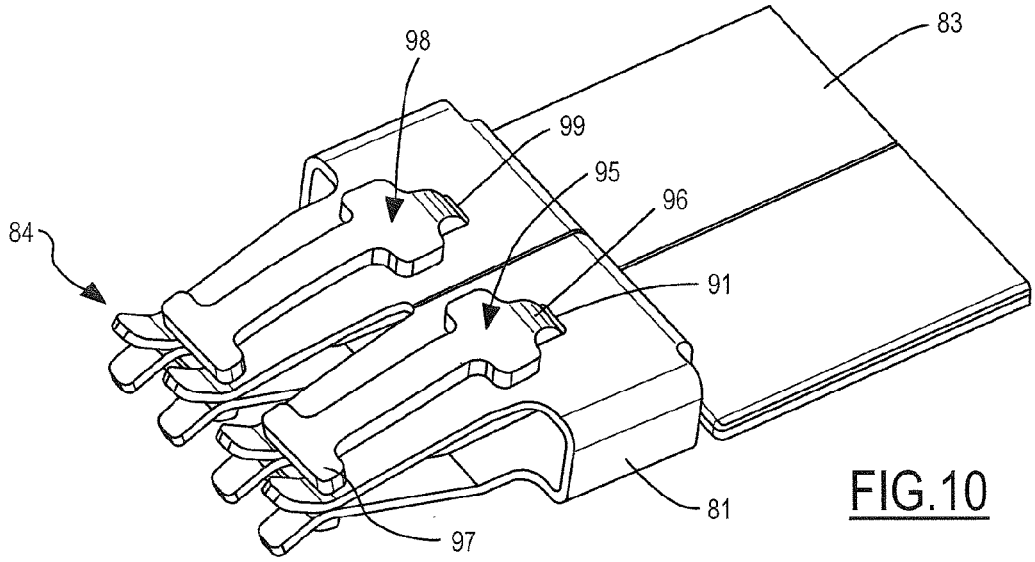
FIG. 10 is a perspective view of a terminal receptor with another alternate clamping member.

Referring now to FIG. 8, a female terminal receptor 80 has a body 81 formed with a termination area 83 at one end and a plurality of pairs of opposing beams 84 at the other end. Each pair of first opposing beams 84 spreads apart to receive the blade terminal of the power distribution box. A clamping member 82 is U-shaped has a base portion 89 which is laterally disposed between at least two pairs of the opposing beams 84 at a recess 91 formed between adjacent beam pairs. Clamping member 82 has at least one end portion 90 disposed over at least one of the opposing beams for applying a predetermined compression force. Beam pairs 84 include beam pair 85, beam pair 86, beam pair 87, and beam pair 88. FIGS. 8-10 show a single terminal receptor by itself, as would be used for a simple connector. Termination area 83 would be connected to a wire or other conductor by crimping, welding, or other known methods. In the case of a fuse, termination area 83 would be joined with another terminal receptor to form a fuse in the same manner as shown in FIGS. 1-7.

Body 81 and opposing beam pairs 84 have a first metallic composition and U-shaped clamping member 82 has a second metallic composition, wherein the first metallic composition has a higher conductivity than the second metallic composition, and wherein the second metallic composition has a higher relaxation temperature than the first metallic composition. The first metallic composition may consist of any desirable high conductivity material, and may preferably consist of nearly pure copper (e.g., copper C102) or copper with trace amounts of other substances (e.g., copper C151 which includes about 0.1% zirconium). The second metallic composition may consist of stainless steel, such as SS301 which includes about 17% chromium, 10% carbon, 7% nickel, and the remainder is iron.

The geometry of the opposing pairs of beams and the geometry of the clamping members are designed to optimize normal forces and the contact area obtained between the terminal receptors and the blade terminals. Instead of all the normal forces being provided by the clamping members, the opposing beams are configured to apply an inward normal force against the blade terminals so that the opposing beams do not subtract from the normal forces provided by the clamping members. In other words, the opposing beams must spring open in order to receive the male blade terminal so that the normal forces of the opposing beams are against the male blade terminal and not against the clamping member. More specifically, the blade terminals have a first predetermined thickness. Each pair of opposing beams is separated by less than the first predetermined thickness while in their rest positions, so that the opposing beam would spread apart to receive the blade terminals even if the clamping members were not in place. Each pair of opposing beams has a second aggregate thickness where they are contacted by the respective end portions of the clamping members (e.g., twice the thickness of the stainless steel sheet used to form the clamping members). The end portions disposed over respective opposing beams are separated by less than the sum of the first predetermined thickness and the second aggregate thickness while in their rest positions (i.e., before they are assembled over the opposing beam pairs).

FIG. 9 illustrates an alternative embodiment of the clamping member used with four opposing beam pairs. Clamping member 92 has individually projecting legs with separate end portions 93 and 94, wherein the projecting legs are joined near the base portion of clamping member 92. Each end portion provides clamping for two of the opposing beam pairs of the terminal receptor.

FIG. 10 illustrates the use of more than one clamping member. Thus, a clamping member 95 with a base portion 96 and an end portion 97 is mounted in a recess 91 between the corresponding pairs of opposing beams. Likewise, a clamping member 98 is mounted in a recess 99 between other corresponding pairs of opposing beams.

Figure 11:
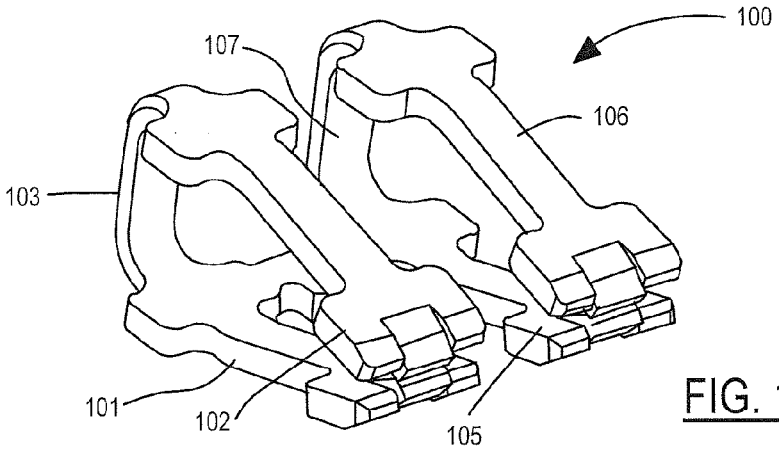
FIGS. 11 and 12 are perspective views of one embodiment of the clamping member.
Figure 12:
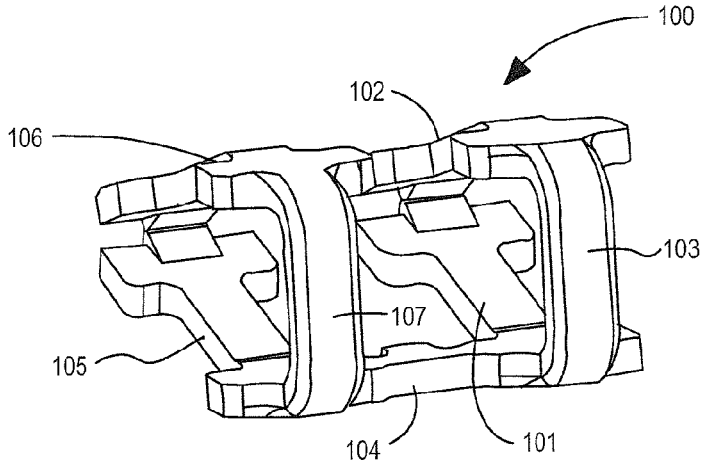

FIGS. 11 and 12 show one embodiment of a clamping member 100 in greater detail. First leg 101 and second leg 102 are joined by a base portion 103. A cross member 104 connects base portion 103 with another base portion 107, from which third leg 105 and fourth leg 106 extend.

Figure 13:
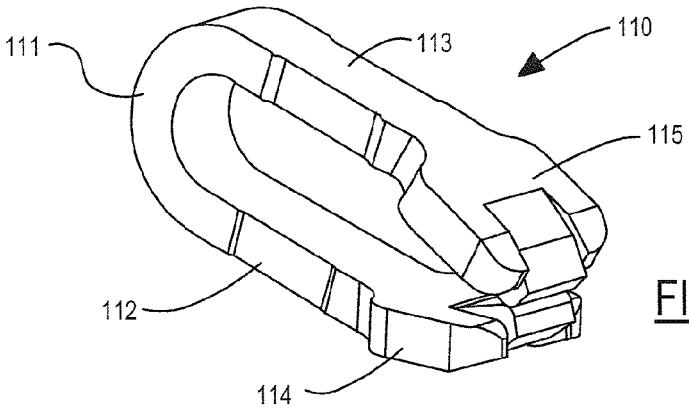
FIG. 13 is a perspective view of another embodiment of the clamping member.

FIG. 13 shows a clamping member 110 with a base portion 11 and legs 112 and 113. End portions 114 and 115 have a width selected to extend over two adjacent pairs of opposing beams. Using a clamping member that fits between just two adjacent beam pairs, any total number of beam pairs on a terminal receptor can be accommodated by selecting a matching combination of clamping members.

Figure 14:
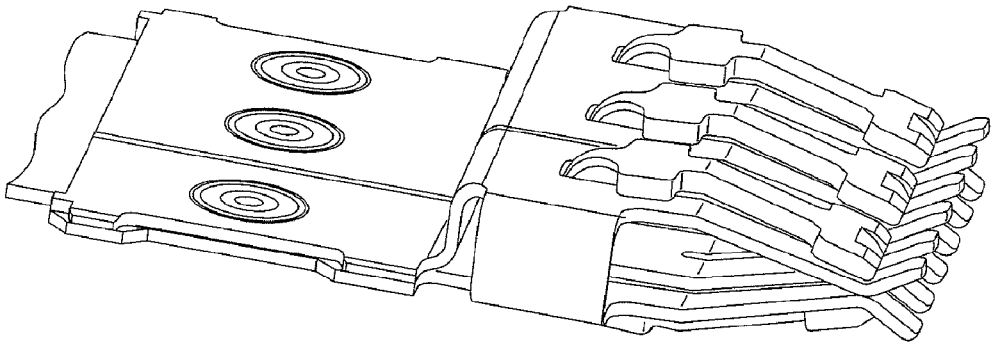
FIGS. 14 and 15 are perspective views of a terminal receptor having six pairs of opposing beams.
Figure 15:
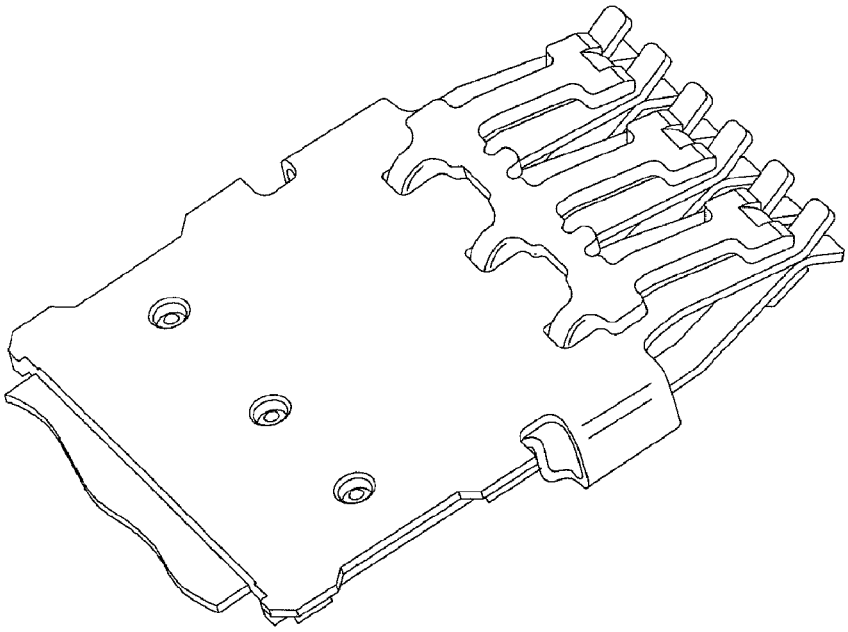

FIGS. 14 and 15 illustrate a terminal receptor having three pairs of opposing beams. Three clamping members of the type shown in FIG. 13 are used.

Figure 16:
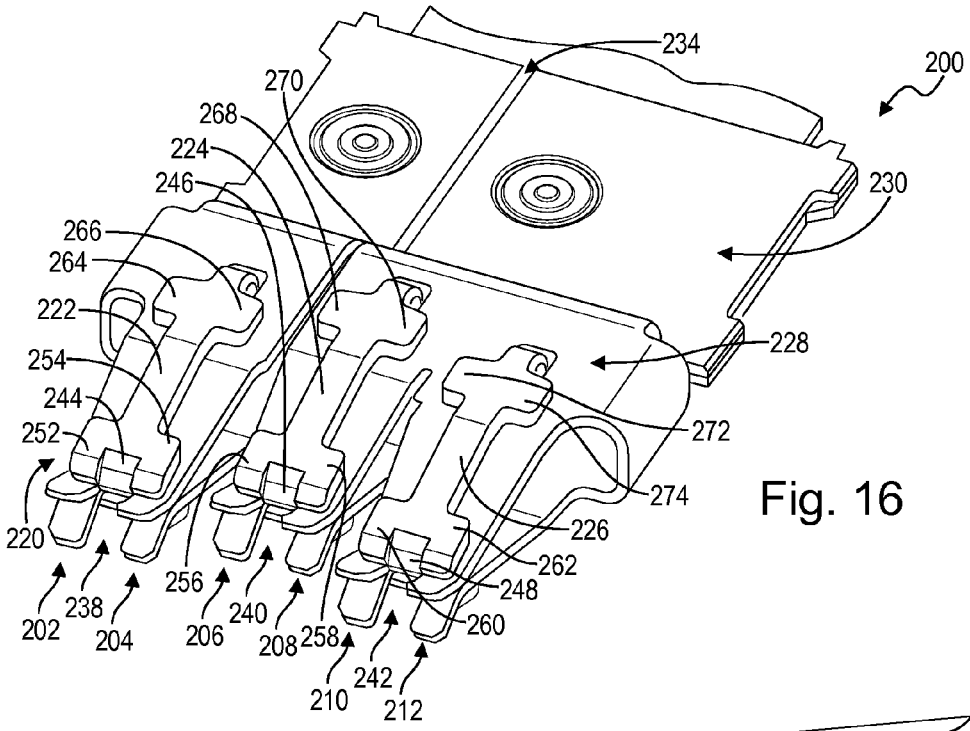
FIG. 16 illustrates a terminal having pairs of opposing beams arranged in a staggered configuration.

FIG. 16 illustrates a terminal 200 having pairs of opposing beams arranged in a staggered configuration. The staggered configuration corresponds with at least one of the beam pairs 206, 208 being offset relative to a forward or a blade insertion end of the beam pairs 206, 208. The offset can be helpful in reducing and controlling the amount of insertion force required for inserting the male blade between the opposed beam pairs 206, 208, 210, 212 by limiting the number of beam pairs 206, 208, 210, 212 engaging the leading end of the male terminal at the same time. The present invention contemplates a scalable arrangement where the number of opposed beams 206, 208, 210, 212 can be increased simply by cutting more beam legs from a sheet of material since each successive pair 206, 208, 210, 212 may be a replication of a single pair designed to a set of engineering criteria, i.e., if the mechanical integrating of one pair is sufficient then that pair can be replicated. The amount of insertion force can become more critical as the number of beam pairs 206, 208, 210, 212 increases as each beam pair 206, 208, 210, 212 contacting the blade at the same time increases the amount of insertion force.

Another factor in the amount of insertion force is the spring clip 220 (three separate clamps 222, 224, 226 are shown in FIG. 16 to be positioned between each adjoining beam pair 206, 208, 210, 212). Since each clip 220 provides additional compressive force to the compressive force of the opposed beam pairs 206, 208, 210, 212, it may be desirable to control the resulting force normal force by correspondingly selecting materials for the clip/terminal 222, 224, 226, 228 body and/or by selectively adjusting the dimensioning (length, width, angle, etc.) of the beam pairs 206, 208, 210, 212. The electrical capabilities of the terminal 200 may also be considered when determining the amount of desired normal force as it may be desirable to increase the insertion normal force, and thereby the normal force, in order to maximize current capabilities, such as to support high power operations (e.g., 80+A, 100+VDC).

The beam pairs 206, 208, 210, 212, for example, may be configured to provide 4 newton (N) of normal force in the absence of the spring clip 220. Addition of the spring clip 220 may increase the normal force at the contact area to between 12-15 N. These parameters may be selectively adjusted to achieve a balance between the amount of normal force and a rise over ambient temperature (ROA) through the connection region for a given amount of current. The rise over ambient temperature may relate to an amount of current that may pass through the contact area between the beam pairs and male blade at a particular normal force before a rise in 55° C. over ambient temperature is achieved. The following table illustrates one example of such a relationship.

| Normal Force (Newton) | Current (Ampere) |
|---|---|
| 5 | 150 |
| 10 | 180 |
| 15 | 200 |
| 20 | 201 |

As shown in the table, increases in normal force allow for corresponding increases in current prior to achieving 55° C. ROA. At some point, however, the rate of increase begins to slow, which is shown to occur around 15N (this transitional point may change significantly depending on materials and the configuration, shape, etc. of the contact point). One non-limiting aspect of the present invention contemplates selecting the optimized amount of additional force applied by the spring clip 220 relative to the current carrying capabilities. The balancing of normal force versus current capabilities can be important as it may be desirable to use the least amount of normal force to meet current and ROA requirements while at the same time limiting the amount of insertion force. Additionally, the surface roughness of the blade and the opposed beams 206, 208, 210, 212 may be similarly controlled in order to reduce insertion force, such as by limiting the surface roughness to between 0.8 and 1.6 RA. Double coining or other coining processes may be used to further refine the surface roughness of the blade and beam pairs.

The beam pairs 206, 208, 210, 212, terminal body 226, and terminal area 230 may be made from the same piece of material. The material may include the same or varying thickness throughout (e.g., portions may be thicker or thinner to improve stability, to control forces, etc.). The material may be cut, stamped or otherwise manipulated from a solid material shaped to include recesses, reliefs, apertures, and other formations necessary to facilitate folding, bending, or other manipulating required to convert the flat piece of material into the illustrated configuration. Opposed sides of the material may be folded over toward each other such that a split or fold line 234 is formed proximate the two sides once positioned to the illustrated configuration. Once the terminal 200 is arranged into the illustrated shape, the spring clip(s) 220 may be positioned to insert the clamps 222, 224, 226 within channels defined by adjoining beams 206, 208, 210, 212. This may be accomplished by using an arbor or other device to open the clamps 222, 224, 226 a distance which allows the rearward closed end of the clamps 222, 224, 226 to slide within the channels 238, 240, 242 a distance sufficient to allow the forward open ends to pass over the leading ends of the beams 206, 208, 210, 212 such that the forward end of the clamps 222, 224, 226 rest proximate the contact area between opposed beams 206, 208, 210, 212.

The clamps 222, 224, 226 may include a lance 244, 246, 248 proximate a valley of a V-shaped trough included within each beam pair 206, 208, 210, 212. The lance 244, 246, 248 may extend a distance inwardly relative to the outer surfaces of the opposed beams 206, 208, 210, 212 into each channel 238, 240, 242, as reflected with the illustrated inward bend of the clamps 222, 224, 226. The lance 244, 246, 248 may be approximately equal in width to the width of the channels 238, 240, 242 to provide a slight interference fit therebetween. The positioning of the lance 244, 246, 248 within the channels 238, 240, 242 may be helpful to prevent or severely limit the spring clip 220 from rotating. Lateral extensions 252, 254, 256, 258, 260, 262, 264, 266, 268, 270, 272, 274 may be included proximate each lance 244, 246, 248 and at a point rearward thereof. The lateral extensions 252, 254, 256, 258, 260, 262, 264, 266, 268, 270, 272, 274 may extend outwardly over an outer surface of the opposed pairs 206, 208, 210, 212 to limit pitching/yawing of the spring clip 220. The lance 244, 246, 248 and lateral extension 252, 254, 256, 258, 260, 262, 264, 266, 268, 270, 272, 274 are shown to have the same material thickness with the lance 244, 246, 248 being formed by bending a portion of each clamp 222, 224, 226 inwardly.

Figure 17:
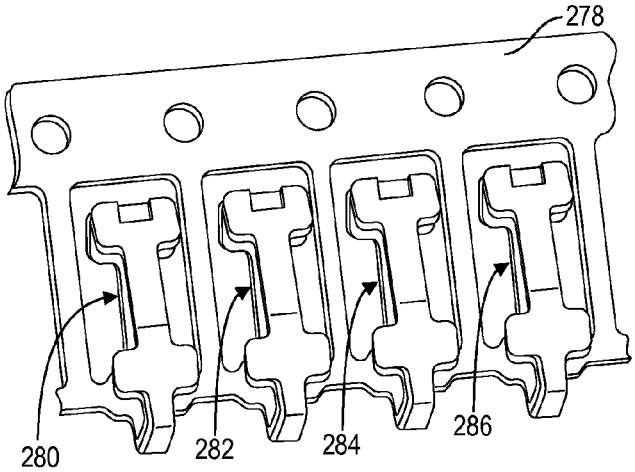
FIG. 17 illustrates a number of clamps as attached to the flat sheet of material.

The spring clip 220 may be manufactured in a process in which each clamp leg is formed flat and then individually bent from a flat sheet 278 into the illustrated U-shape. FIG. 17 illustrates a number of clamps 280, 282, 284, 286 as attached to the flat sheet of material. The material may be cut at desired intervals to form spring clips with a desired number of clamps. The clamps may be uniformly spaced along with the terminals legs extending from the terminal body 228 to facilitate assembly whereby rolls or sheets of spring clips may be delivered prior to cutting. The desired number of clamps may then be cut from the roll depending on the particular configuration of the terminal 220.

Figure 18:
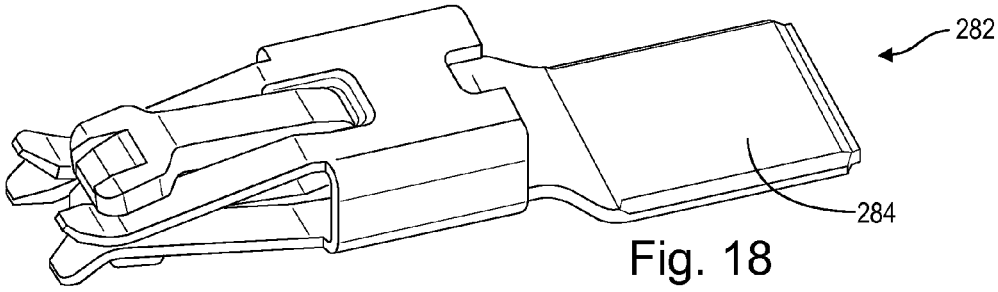
FIG. 18 illustrates a weldable variant of the terminal that provides a terminal area for welding.
Figure 19:
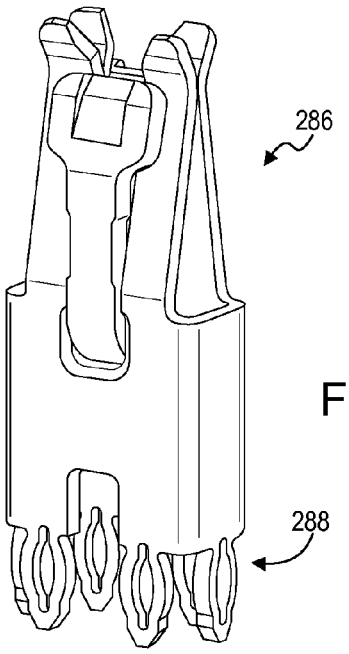
FIG. 19 illustrates a terminal being configured to provide an attachment feature for terminating to a printed circuit board.
Figure 20:
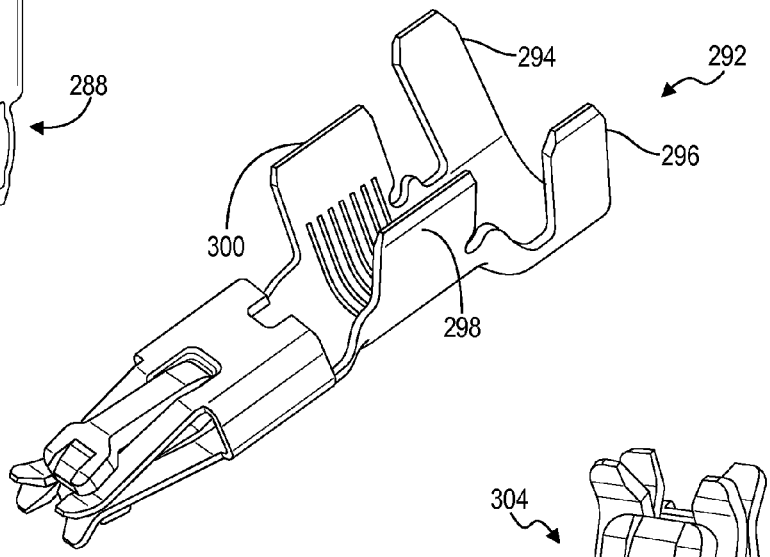
FIG. 20 illustrates a terminal being configured to provide a clamp variant for terminating to a wire.
Figure 21:
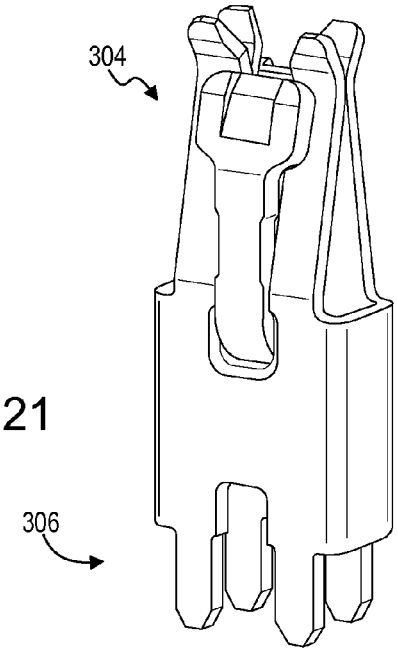
FIG. 21 provides another PC board variant where the terminal provides attachment for terminating to a printed circuit board.
Figure 22:
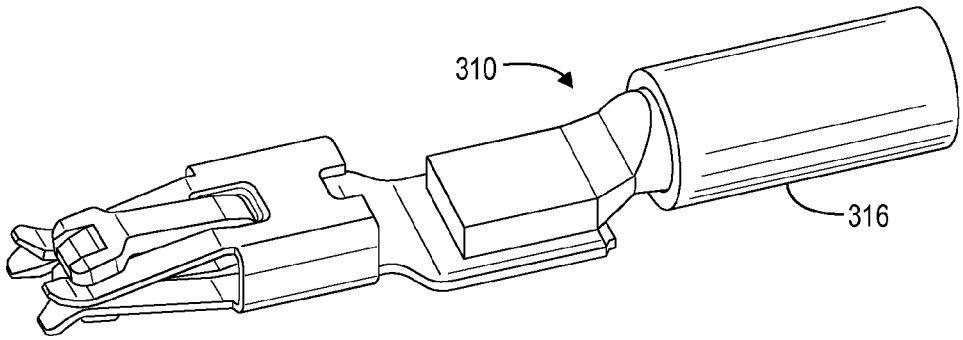
FIGS. 22-24 illustrate various weld angles that may be used to weld to the terminal.
Figure 23:
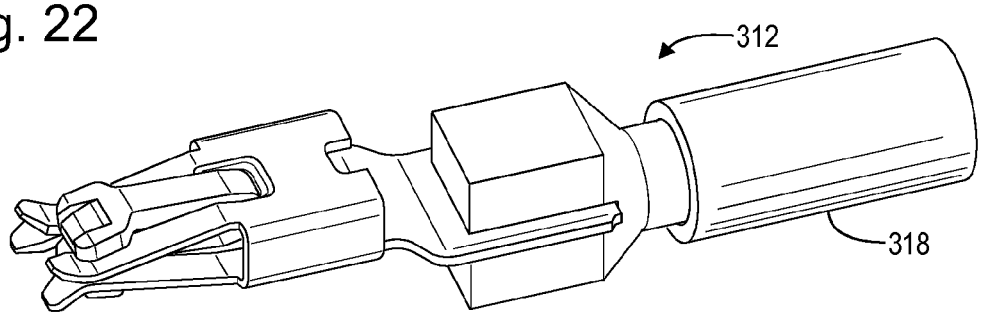
Figure 24:
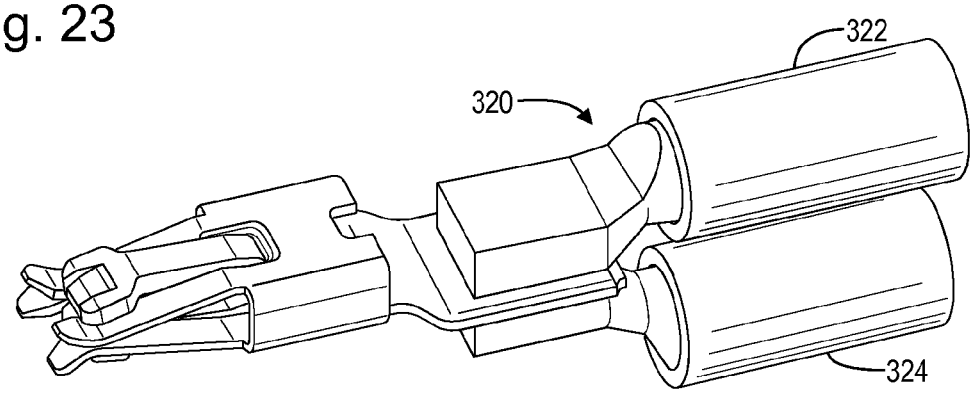
Figure 25:
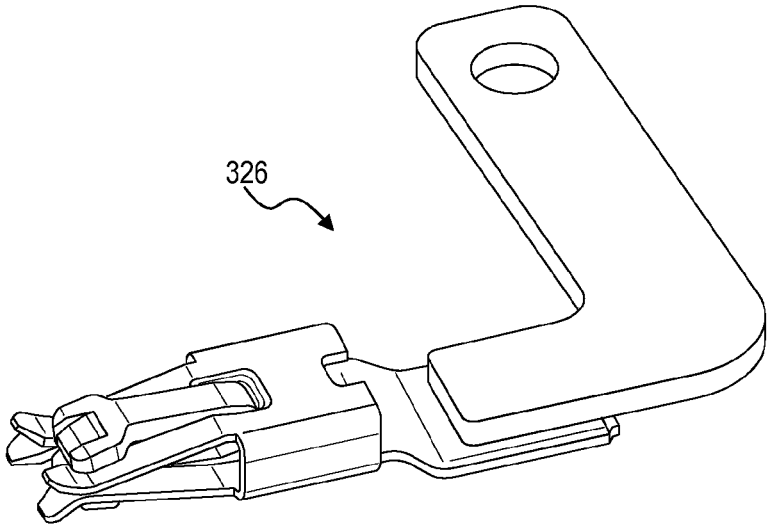
FIG. 25 illustrates a bus weld configuration for welding a bus bar to the terminal.
Figure 26:
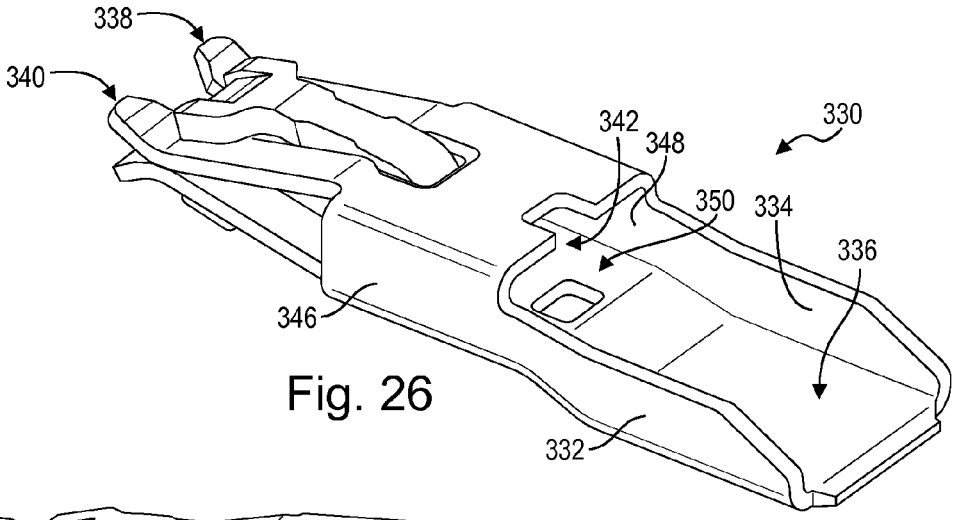
FIG. 26 illustrates a terminal being configured to have raised sides proximate a terminal area to increase terminal rigidity and increase current carrying capacity.
Figure 27:
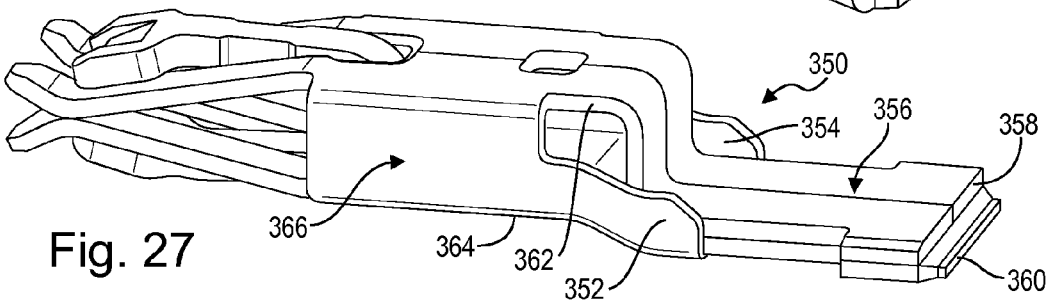
FIG. 27 illustrates a terminal being configured to have raised sides partially extending into a terminal area to increase terminal rigidity and increase current carrying capacity.
Figure 28:
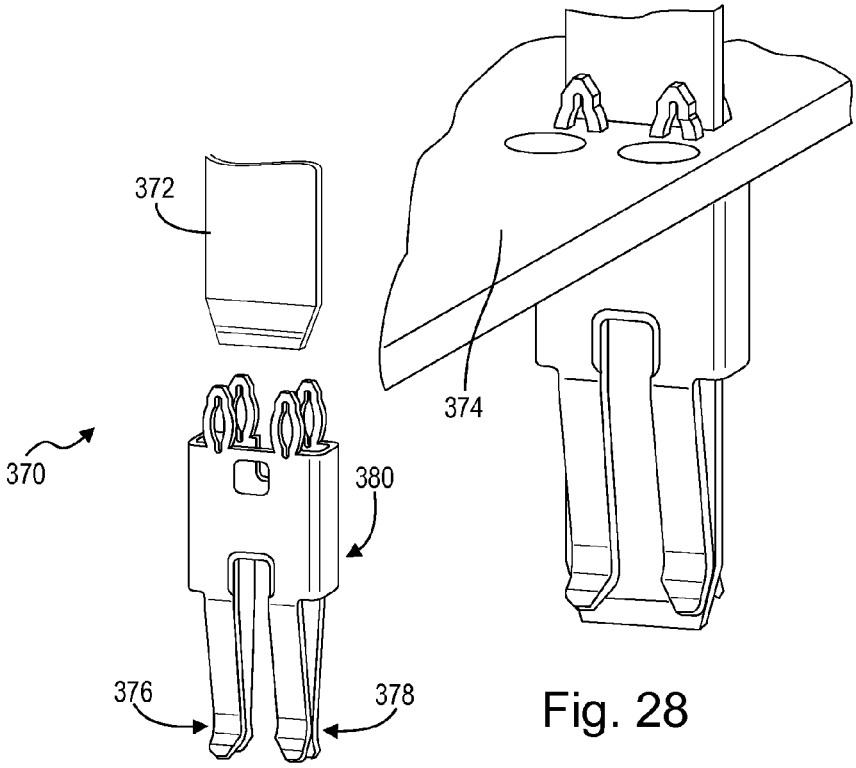
FIG. 28 illustrates a male blade mating configuration where a male blade inserted through a printed circuit board is compressed between opposed beams within an area previously occupied by the spring clip.

FIG. 18 illustrates a weldable terminal 282 that provides a terminal area 284 for welding a wire or bus bar, such as with ultrasonic welding. FIG. 19 illustrates a terminal being configured to provide an attachment feature for terminating to a printed circuit board with a solder free connection where oval shaped pins 288 are inserted within a printed circuit board for securement. FIG. 20 illustrates a terminal 292 being configured to provide a clamp variant for terminating to a wire by means of crimping tabs 294, 296, 298, 300. FIG. 21 provides another PC board variant where a terminal 304 provides attachment for terminating to a printed circuit board with solid connections 306. FIGS. 22-23 respectively illustrate a single and double-sided terminal 310, 312 configurations for connecting to a single wire 316, 318. FIG. 24 illustrates a double-sided terminal 320 configuration for electrically connecting two separate cables 322, 324. FIG. 25 illustrates a bus terminal 326 configuration for welding to a bus bar. FIG. 26 illustrates a terminal 330 being configured to have raised sides 332, 334 proximate a terminal area 336 to increase terminal rigidity and increase current carrying capacity. The terminal area 336 extends in a opposite direction of the opposed beams 338, 340 from a body portion cavity 342 for connection to a conducting element (not shown). The terminal area 336 is shown to include the opposed side supports 332, 334 and the bottom support 336 respectively extending away from opposed lateral sides 346, 348 and bottom side 350 of the body portion 342. The side supports 332, 334 may be contiguously formed with the opposed lateral sides 346, 348 to have a least half of a height of the lateral sides 346, 348 and extending substantially along an entire length of the terminal area 336. FIG. 27 illustrates a terminal 350 being configured to have raised sides 352, 354 partially extending into a terminal area 356 to increase terminal rigidity and increase current carrying capacity. The terminal area 356 may be configured to have opposed top and bottom supports 358, 360 respectively extending away from top and bottom sides 362, 364 of a body portion 366. The top support 358 may be bent downwardly from the top side 362 to lie in contact with the bottom support 360 in a double-layer configuration. The top and bottom supports 358, 360 respectively may be contiguously formed with the top and bottom sides 362, 364. FIG. 28 illustrates a male blade mating configuration 370 where a male blade 372 inserts through a printed circuit board 374 is compressed between opposed beams 376, 378 of terminal 380.

As supported above a terminal is disclosed. The terminal may include a base terminal and a spring clip assembled together. The terminal may include multiple contact beams made of highly conducted alloy (for example C151, C102, or similar). One side of the terminal may include a single layer/wire interface area having a vertical rib for mechanical rigidity/reinforcement, where the rib may also include a cross-section for electrical performance and to guide wire positioning during welding. Another design of the terminal may include features to facilitate mounting/attaching the terminal directly to a PC board, such as by using a straight leg stamped terminal body that allows the legs to be attached to the PC board using soldering. An optimum leg cross-section can be calculated by taking a total cross-section of all the beams and dividing by a number of legs. One design of the terminal may include an attachment feature having straight legs that can be shaped as eyelets or needle eyes to facilitate connection through the PCB. The contact spring can be made of an alloy with high springiness (e.g., stainless steel 301). The spring clip may include a spring member pad per each contact beam with each pair of pads connected to opposite sides of a pair of beams. The contact springs may be configured to provide high normal force, particular with respect to high temperature situations with wires that are mechanically and/or electrically connected to the terminal to provide maximum current surface and maximum current carrying capacity in high temperature environments. The wires can be attached to the terminal by welding, crimping or other operations. The wires can be welded to the terminal in multiple directions and can have strands split and welded to each side of the terminal. Also, a bus bar can be used instead of the wire strands and soldered to or compressed between the beams to establish connection to the terminal.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A female terminal for an electrical connector for connecting to a male blade terminal comprising:

at least one or more pairs of opposing beams for contact against the male blade terminal, each adjoining pair of opposing beams defining a recess therebetween; and a U-shaped clamping member positioned within each recess to apply a compressive force to the adjoining pair of opposing beams;

wherein each U-shaped clamping member includes at least one alignment portion configured to prevent the U-shaped clamping member from movement; and wherein the at least one alignment portion includes a lance that extends downwardly into the recess at least a first distance below an outer surface of the adjoining pair of opposing beams to limit movement.

2. The female terminal of claim 1 wherein the at least one alignment portion includes a first set of lateral extensions on opposite sides of the lance, the first set of lateral extensions respectively extending outwardly from opposite sides of the lance over the outer surface of the adjoining pair of opposing beams to limit movement.

3. The female terminal of claim 2 wherein the at least one alignment portion includes a second set of lateral extensions space apart from the first set of lateral extensions, the second set of lateral extensions extending outwardly over the outer surface of the adjoining pair of opposing beams to limit movement.

4. The female terminal of claim 3 wherein the U-shaped clamping member includes at least one pair of opposing legs joined at one end to a base, and wherein the lance and the first and second sets of lateral extension are included on each leg.

5. The female terminal of claim 1 wherein the opposing beams have a first metallic composition and the U-shaped clamping member has a second metallic composition, wherein the first metallic composition has a higher conductivity than the second metallic composition.

6. The female terminal of claim 5 wherein the second metallic composition has a higher relaxation temperature than the first metallic composition.

7. A female terminal for an electrical connector for connecting to a male blade terminal comprising:

at least one or more pairs of opposing beams for contact against the male blade terminal, each adjoining pair of opposing beams defining a recess therebetween; and a U-shaped clamping member positioned within each recess to apply a compressive force to the adjoining pair of opposing beams;

wherein each U-shaped clamping member includes at least one alignment portion configured to prevent the U-shaped clamping member from movement; and at least two pairs of opposing beams wherein at least one of the at least two pairs of opposing beams is staggered relative to the other of the at least two pairs of opposing beams.

8. The female terminal of claim 1 wherein the beams extend in the same direction from a body portion, the body portion defining a cavity between opposed top and bottom sides space apart relative to opposed lateral sides, the beams connecting exclusively to the top and bottom sides.

9. The female terminal of claim 8 further comprising a terminal area extending in an opposite direction of the beams from the body portion for connection to a conducting element.

10. The female terminal of claim 9 wherein the terminal area is shaped to include at least four connection pins.

11. The female terminal of claim 9 wherein the terminal area is shaped to include at least two spaced apart crimping tabs.

12. A female terminal for an electrical connector for connecting to a male blade terminal comprising:

at least one or more pairs of opposing beams for contact against the male blade terminal, each adjoining pair of opposing beams defining a recess therebetween; and a U-shaped clamping member positioned within each recess to apply a compressive force to the adjoining pair of opposing beams;

wherein each U-shaped clamping member includes at least one alignment portion configured to prevent the U-shaped clamping member from movement;

wherein the beams extend in the same direction from a body portion, the body portion defining a cavity between opposed top and bottom sides space apart relative to opposed lateral sides, the beams connecting exclusively to the top and bottom sides;

wherein the female terminal further comprises a terminal area extending in an opposite direction of the beams from the body portion for connection to a conducting element; and wherein the terminal area includes opposed side supports and a bottom support respectively extending away from the opposed lateral sides and bottom side, the side supports being contiguously formed with the opposed lateral sides and having a least half of a height of the lateral sides and extending substantially along a length of the terminal area, the bottom support being continuous with the bottom side.

13. A female terminal for an electrical connector for connecting to a male blade terminal comprising:

at least one or more pairs of opposing beams for contact against the male blade terminal, each adjoining pair of opposing beams defining a recess therebetween; and a U-shaped clamping member positioned within each recess to apply a compressive force to the adjoining pair of opposing beams;

wherein each U-shaped clamping member includes at least one alignment portion configured to prevent the U-shaped clamping member from movement;

wherein the beams extend in the same direction from a body portion, the body portion defining a cavity between opposed top and bottom sides space apart relative to opposed lateral sides, the beams connecting exclusively to the top and bottom sides;

wherein the female terminal further comprises a terminal area extending in an opposite direction of the beams from the body portion for connection to a conducting element; and wherein the terminal area includes opposed top and bottom supports respectively extending away from the top and bottom sides, the top support bending downwardly from the top side to lie in contact with the bottom support, the top and bottom supports respectively being contiguously formed with the top and bottom sides.

14. The female terminal of claim 1 wherein the at least one or more pairs of opposing beams compress against the male blade terminal with a first compressive force; and wherein the compressive force of the U-shaped clamping member is further defined as a second compressive force adding to the first compressive force to create a third compressive force, the third compressive force being greater than the first compressive force and the second compressive force.

15. The female terminal of claim 14 wherein the third compressive force is sufficient to cause a forward end of each pair of opposing beams to touch.

16. The female terminal of claim 1 wherein the at least one alignment portion is configured to prevent the U-shaped clamping member from at least one of in-recess pitching and rotating.

17. The female terminal of claim 1 wherein the lance limits rotating.

18. A female terminal for an electrical connector for connecting to a male blade terminal comprising:

at least one or more pairs of opposing beams for contact against the male blade terminal, each adjoining pair of opposing beams defining a recess therebetween; and a U-shaped clamping member positioned within each recess to apply a compressive force to the adjoining pair of opposing beams;

wherein each U-shaped clamping member includes at least one alignment portion configured to prevent the U-shaped clamping member from movement; and wherein the U-shaped clamping member includes at least one pair of opposing legs joined at one end to a base with a cross member connecting the base of each adjoining U-shaped clamping member.

19. The female terminal of claim 18 wherein the at least one alignment portion includes a lance that extends downwardly into the recess at least a first distance below an outer surface of the adjoining pair of opposing beams to limit movement.

20. An electrical connector comprising:

at least one or more pairs of opposing legs extending from a body portion, each leg having a substantially equal thickness and sloping inwardly relative to an outer perimeter of the body portion to a contact point where an inner surface of each opposing leg contact; and a spring clip attached over an outer surface of each opposing leg to increase a compressive force between opposing legs, wherein the spring clip includes a lance extending inwardly relative to an outer surface of adjoining pairs of opposing legs to limit spring clip movement;

wherein a width of the lance is approximately equal to a gap between adjoining pairs of opposing legs and wherein the spring clip includes lateral extensions on opposing sides of each lance and at a position rearward of the lance toward the body portion, the lateral extension extending over the outer surface of each leg to limit spring clip movement.

* * * * *